United States Patent [19]

Ret

[11] 4,181,167

[45] Jan. 1, 1980

[54] CLUB ORGANIZER FOR GOLF BAG

[76] Inventor: Leo J. Ret, 15 Latham Vill. Ln., #6, Latham, N.Y. 12110

[21] Appl. No.: 916,085

[22] Filed: Jun. 16, 1978

[51] Int. Cl.[2] ..... A63B 55/00

[52] U.S. Cl. ..... 150/1.5 R; 211/60 G

[58] Field of Search ..... 150/1.5 R, 1.5 B, 1.5 C; 211/60 G

[56] References Cited

U.S. PATENT DOCUMENTS

| | | | |
|---|---|---|---|
| 1,756,902 | 4/1930 | Boyce | 150/1.5 R |
| 2,551,780 | 5/1951 | Wood | 150/1.5 R |

*Primary Examiner*—Donald F. Norton

*Attorney, Agent, or Firm*—Howard I. Podell

[57] ABSTRACT

A club organizer having a round base provided with fourteen spaced tubes for receiving the end of the club shafts; reflective elements inwardly disposed relative to each tube to aid in locating the tubes; an open top connected to the base by a plurality of rods shorter than the length of the clubs; a club holder of resilient elastomeric material is secured to the top and has along its inner periphery a series of fourteen laterally spaced resilient notches communicating with the open center of the holder by a slot. The organizer is of a size suitble for insertion in a conventional golf bag.

5 Claims, 6 Drawing Figures

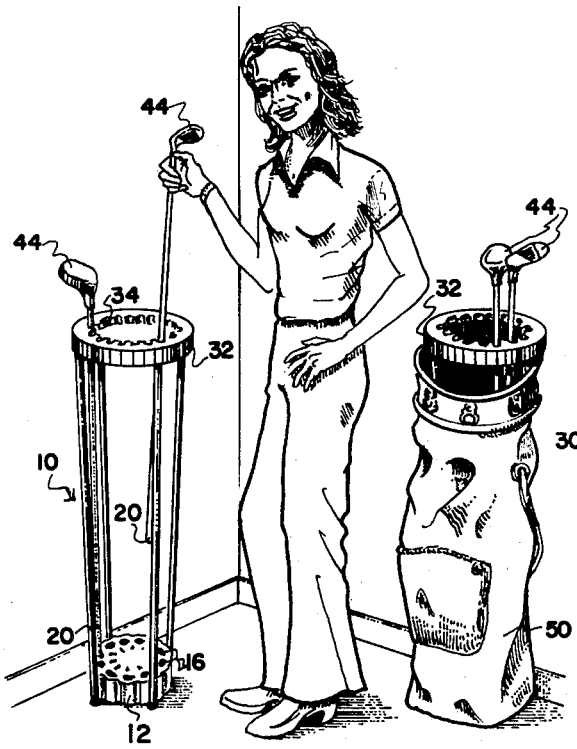
FIG. 1A
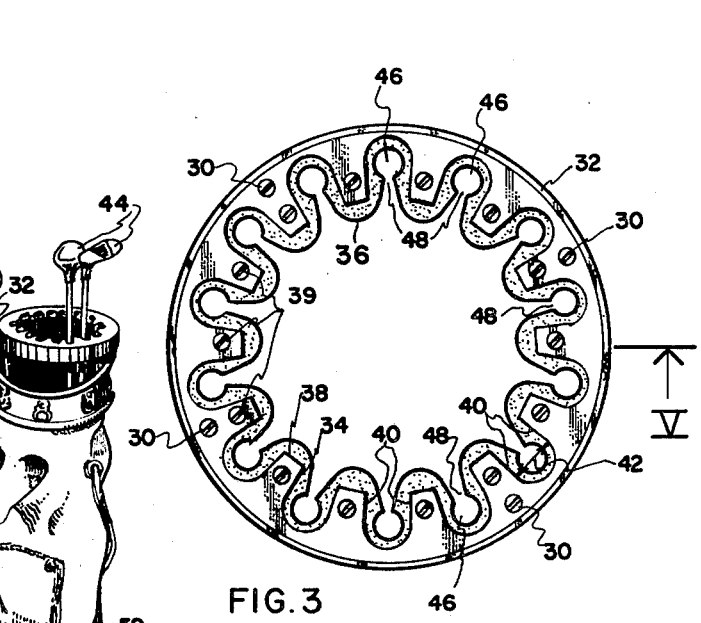
FIG. 1B
FIG. 3
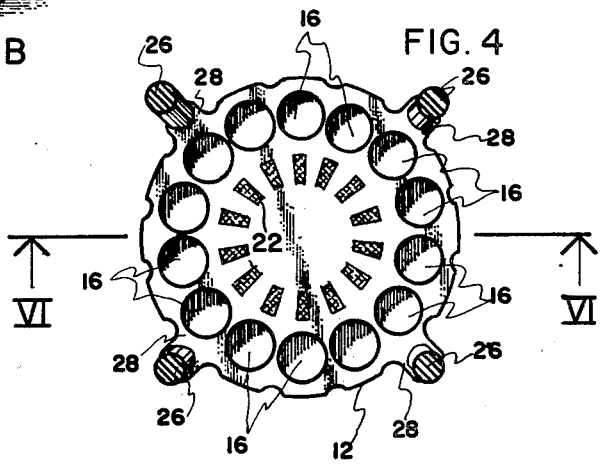
FIG. 4
FIG. 2
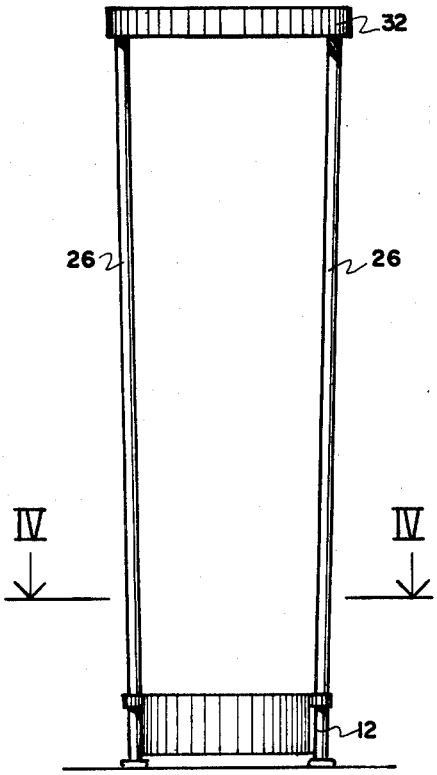
FIG. 5
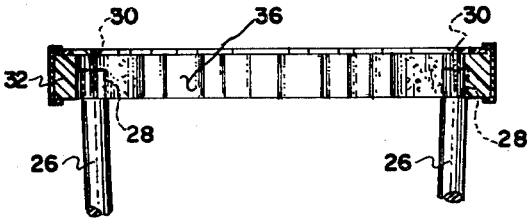
FIG. 6
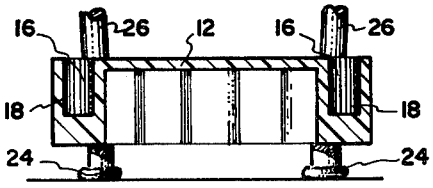

CLUB ORGANIZER FOR GOLF BAG

FIELD OF THE INVENTION

This invention relates generally to a club organizer for association with a golf bag.

DESCRIPTION OF THE PRIOR ART

The prior art, as exemplified by U.S. Pat. Nos. 3,503,518; 2,480,597; 3,966,051; 2,091,298; 3,147,988; and 2,538,374 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practice of the invention, the objects and advantages being realized and attained by means of the instrumentalities and combinations particularly pointed out in the appended claims.

SUMMARY OF THE INVENTION

This invention resides in a club organizer having a round base provided with fourteen spaced tubes for receiving the end of the club shafts; reflective elements inwardly disposed relative to each tube to aid in locating the tubes; an open top connected to the base by a plurality of tubes shorter than the length of the clubs; a club holder of resilient elastomeric material is secured to the top and has along its inner periphery a series of fourteen laterally spaced resilient notches communicating with the open center of the holder by a slot. The organizer is of a size suitable for insertion in a conventional golf bag.

BRIEF DESCRIPTION OF THE DRAWING

In the accompanying drawing, in which is shown one of the various possible illustrative embodiments of this invention, wherein like reference character identify the same or like parts:

FIG. 1A is a view in perspective of the club organizer shown alone and FIG. 1B is a similar view of the club organizer in a golf bag;

FIG. 2 is a front elevation of the organizer;

FIG. 3 is a top planar view of same;

FIG. 4 is a sectional view through line IV—IV of FIG. 2;

FIG. 5 is a sectional view taken along line V—V of FIG. 3; and

FIG. 6 is a sectional view taken along line VI—VI of FIG. 4.

DESCRIPTION OF THE PREFERRED EMBODIMENTS

With reference to the drawing, there is shown and illustrated a club organizer constructed in accordance with the principles of the invention and designated generally by reference character 10. The illustrated tangible embodiment of the invention includes a plastic base 12 molded of Plexiglas or other suitable molding powder with fourteen laterally spaced opeings 16 which preferably are fitted with two inch long metal tubes 18 adapted to receive therein the ends of golf club shafts 20 (FIG.1); spaced inwardly from openings 16 are lateral strips of reflecting tape 22 which aid in locating the openings or tubes 18 from above the open top of organizer 10. As shown in FIG. 6, two pairs of plastic tips or legs 24 are secured in any convenient way to the underside of base 12.

Two pairs of rods 26 with threaded lower ends fit in threaded openings 28 in base 12 and are secured by screws 30 to top 32 which is molded of Plexiglas or other plastic and has an open center wth a scalloped inner periphery 34.

A club holder 36 made of resilient elastomeric material such as rubber or plastic is secured by screws 39 to the tabs 38 projecting inwardly from the rim of top 32. Each tab is separated from the adjoining tabs by an arcuate portion 40 forming a round notch 42 therebetween; fourteen such notches are provided to accomodate a complete set of clubs in consecutive order with their heads 44 projecting from the top of the organizer for easy recognition.

As shown in FIG. 3, holder 36 has laterally spaced notches 46 which in their relaxed condition are smaller than the fixed notches 42 over which they are superimposed. A slot 48 about ⅛ inch wide communicates with each notch 46. Owing to the resiliency of the material used for making holder 36, it will be appreciated that when the end of shaft 20 near head 44 is pushed through slot 48 into a notch 46 the ends of the slot will snap back to retain it in notch 46 which will have expanded to its maximum size permitted by fixed notch 48.

To use the organizer 10, the club is pulled laterally from holder 36 and its end is lifted from the base. To replace club, the end of the shaft is inserted in base 12 and its opposite end is pushed into the slot 48 of the top holder 36.

The organizer 10 is shown associated with golf bag 50 in FIG. 1. However, it may be fixed thereto or used without a bag.

As shown, the organizer is of generally trapezoidal configuration but may be made in other shapes.

The operation and use of the invention hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. A club organizer for the golf bag comprising a base having plurality of openings spaced along its periphery for each receiving the end of a golf club shaft; a top having an open center; rods securing said base and said top; said top having a plurality of tabs extending inwardly toward said open center; each tab having arcuate side portions forming fixed notches between the outer periphery of said top and said open center; a club holder formed of resilient elastomeric material secured to said top; said holder formed with a plurality of resilient notches each of which is aligned with a said fixed notch between a pair of tabs for yieldingly gripping the shaft of a golf club near the head thereof.

2. The invention as recited in claim 1, wherein a slot about $\frac{1}{8}$ inch wide connects each of said resilient notches with said open center.

3. The invention as recited in claim 1, wherein said openings in said base contain a metal tube.

4. The invention as recited in claim 1, wherein reflecting strips are fixed inwardly adjacent each of said openings.

5. The invention as recited in claim 1, wherein said club organizer is contained in a golf bag.

* * * * *